US005294068A

United States Patent [19]

Baro et al.

[11] Patent Number: 5,294,068

[45] Date of Patent: Mar. 15, 1994

[54] DISPENSER FOR DIFFERENT WIDTH LABEL ROLLS AND METHOD OF USING

[75] Inventors: Anthony Baro, Boca Raton; Hans Witzky, Pompano Beach, both of Fla.

[73] Assignee: Sensormatic Electronics Corporation, Deerfield Beach, Fla.

[21] Appl. No.: 766,414

[22] Filed: Sep. 26, 1991

[51] Int. Cl.[5] ..... B26F 3/02; B65H 19/00

[52] U.S. Cl. ..... 242/55.53; 206/405; 225/45; D19/69

[58] Field of Search ..... 242/55.53, 55.2, 118.1; 225/44, 45, 46; 206/411, 389, 403, 404, 405, 398; 403/289, 406; D74/1

[56] References Cited

U.S. PATENT DOCUMENTS

| | | | |
|---|---|---|---|
| 2,533,731 | 12/1950 | Gomberg | 242/116 |
| 2,678,777 | 5/1954 | Donkin | 242/55.53 X |
| 2,759,545 | 8/1956 | Rizza | 225/45 X |
| 2,790,609 | 4/1957 | Hawthorne et al. | 206/403 X |
| 2,905,408 | 9/1958 | Frate et al. | 242/118.5 |
| 3,017,132 | 1/1962 | Gnage | 242/71.9 |
| 3,147,897 | 9/1964 | Ratte et al. | 225/44 X |
| 3,447,759 | 6/1969 | Rau | 242/71.9 |
| 4,226,381 | 10/1980 | Katata | 242/71.8 |
| 4,433,782 | 2/1984 | Figge et al. | 206/338 |
| 4,570,869 | 2/1986 | Tsuji | 242/71.9 |
| 4,591,110 | 5/1986 | Wirts et al. | 242/129.8 |
| 4,821,918 | 4/1989 | Turner | 221/70 |
| 4,884,734 | 12/1989 | Kahl, Jr. et al. | 225/46 X |
| 5,083,717 | 1/1992 | Samuelson et al. | 403/289 X |

*Primary Examiner*—Daniel P. Stodola
*Assistant Examiner*—John F. Rollins
*Attorney, Agent, or Firm*—Robin, Blecker, Daley & Driscoll

[57] ABSTRACT

A dispenser for labels supported on a liner formed as a roll wherein the dispenser has a base member and a cover member which are provided with a first bendable latching member and a cooperating second latching member, respectively, for latching the members together. Apertures in the cover member permit access to the first bendable latching member of the base member for permitting the cover member to be unlatched from the base member.

30 Claims, 4 Drawing Sheets

DISPENSER FOR DIFFERENT WIDTH LABEL ROLLS AND METHOD OF USING

BACKGROUND OF THE INVENTION

This invention relates to dispensers for labels carried a roll and, in particular, to dispensers of this type capable of handling label rolls of different widths.

In the electronic article surveillance industry, detectable labels are placed on articles to protect them against theft. In the manufacture of certain types of these labels, e.g., magnetic labels, the labels are formed in a line on a liner or backing which acts as a carrier for the labels. The liner is then wound onto a core to form a roll for transporting the labels and from which the labels can be dispensed for attachment to individual articles.

In order to protect the labels and to permit easy release of the labels from the roll, a dispenser is used to house the roll and to detach individual labels from the roll. Since the label rolls may be of different widths depending upon whether a single line or multiple lines of labels are being carried, it is desirable that the dispensers used for the rolls be able to accommodate different width rolls.

In the dispensers in use today, this dual-roll-width capability is realized using secondary parts provided with the dispenser. These parts must be attached to or detached from the dispenser by the operator to accommodate the width of the particular label roll being used. This often requires the operator to use a hand held tool. Accordingly, the need for secondary parts and, in some cases, a tool in present dual-roll-width dispensers is wasteful of time and energy and also gives rise to the problem of storing the secondary parts so they do not become lost.

It is therefore an object of the present invention to provide a label dispenser of the above type which does not suffer from the above disadvantages.

It is a further object of the present invention to provide a label dispenser which allows for multiple width rolls of labels and which does not require secondary parts and is easy and simple to use.

SUMMARY OF THE INVENTION

In accordance with the principles of the present invention, the above and other objectives are realized in a label dispenser comprising a base member and a cover member which are provided, respectively, with a first bendable latching means and a second latching means which cooperate and are adapted to permit the cover member to be placed on the base member and to be latched to the base member at different latching positions corresponding to different distances or heights of the cover member from the base member. This allows the cover member and base member to together define interior regions of different heights which are able to receive label rolls of different widths.

The first and second latching means are configured such that as the cover member is urged toward the base member the first latching means through bending and then retracting is able to latch to the second latching means at the first latching position and then through further bending and retracting is able to latch to the second latching means at the second latching position.

Aperture means is additionally arranged in the cover member so that when the cover member is placed over the base member, the aperture means permits access to the first latching means for bending the first latching means. This bending is able to unlatch the first and second latching means from each other at the first and/or second latching positions so that the cover member and base member can be detached from each other.

More particularly, the base member includes a bottom wall which is bordered about its periphery by a side wall and whose interior region supports the first latching means. The first latching means has first and second longitudinally spaced latching members and is bendable so as to be able to displace these members. The cover member, in turn, includes a top wall which includes the aperture means and which supports the second latching means. The second latching means has a third latching member.

The second latching means is further arranged on the top wall of the cover member such that when the cover member is placed over the base member, the second latching means engages the first latching means and such that, as the cover member is urged toward the base member, the first latching means is first able to be bent so a to enable the third and first latching members to become latched and such that the first latching means is second able to be bent so as to enable the third and second latching members to become latched.

In the embodiment of the invention to be disclosed hereinafter, the first latching means includes first and second spaced interior walls which have on their outer surfaces longitudinally spaced, laterally extending ribs which together define the first and second latching members. Each interior wall is bendable so as to be able to displace its ribs inwardly and the first latching means further includes first and second fingers extending from the first and second interior walls for applying inward forces to the walls.

The aperture means of the top wall of the cover member includes first and second apertures situated so as to permit access to the first and second fingers of the first latching means of the base member when the cover member is placed over the base member. The third latching member of the cover member is formed from first and second latching flanges which extend downwardly from the top wall of the cover member and engage the outer surfaces of the respective first and second interior walls of the base member. Each latching flange is able to ride over and past the longitudinally spaced upper and lower ribs on the outer surface of the respective interior wall when the cover member is urged downwardly on the base member.

When the latching flanges pass the upper ribs on the first and second interior walls, the latching flanges become latched to the interior walls by these upper ribs at a first height corresponding to the first latching position. At this position, the cover member and base member thus define a first interior region of first height. When the latching flanges pass the lower ribs, the latching flanges become latched to the first and second interior walls by these lower ribs at a second height corresponding to the second latching position. At this second position, the cover member and base member now define a second interior region of second height.

Release of the latching members so as to permit removal of the cover member is effected by accessing the fingers of the base member through the apertures in the top wall of the cover member. Inward forces on the fingers cause the interior walls and thus their respective ribs to move inwardly, allowing the latching flanges to move upwardly past the ribs, thereby unlatching the latches and permitting withdrawal of the cover member.

Also, in the disclosed embodiment, the first and second latching flanges extend downwardly from outer circumferential areas of the first and second apertures and then inwardly, while inner circumferential areas of the apertures are provided with downwardly extending members which allow the cover to be gripped during withdrawal and which also provide stops for limiting the inward movement of the first and second fingers. Furthermore, in the disclosed embodiment, attention is focused on the apertures by locating them in a recessed area of the top wall of the cover member and by causing them to also decrease in dimension when proceeding inwardly. The upper and lower sets of ribs, in turn, slope outwardly when proceeding downwardly so as to aid in the latching flanges moving downwardly past the ribs.

Additionally, in the disclosed embodiment, the base member is provided with an additional sidewall portion which defines a handle for holding the dispenser.

SUMMARY OF THE DRAWINGS

The above and other features and aspects of the present invention will become more apparent upon reading the following detailed description in conjunction with the following drawings, in which.

DETAILED DESCRIPTION

Figure 1A:
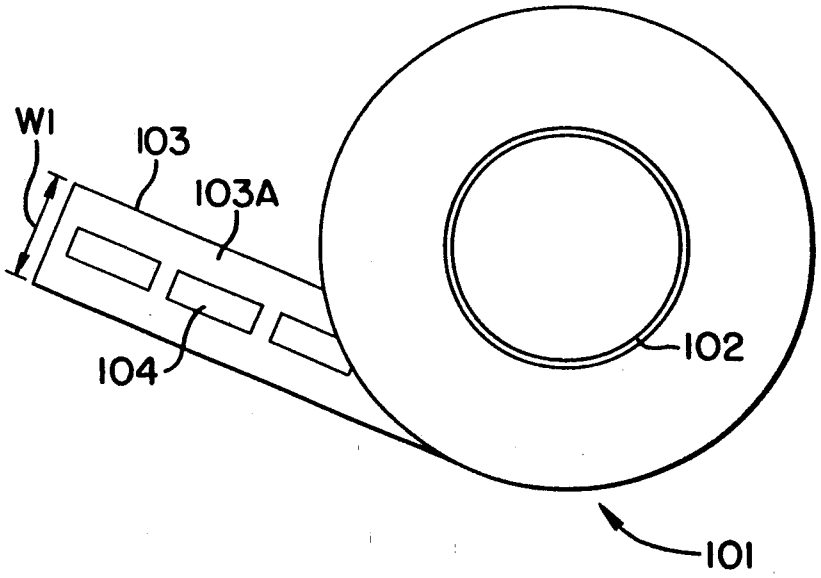
FIGS. 1A and 1B show representative label rolls for use with a dispenser in accordance with principles of the present invention.
Figure 1B:
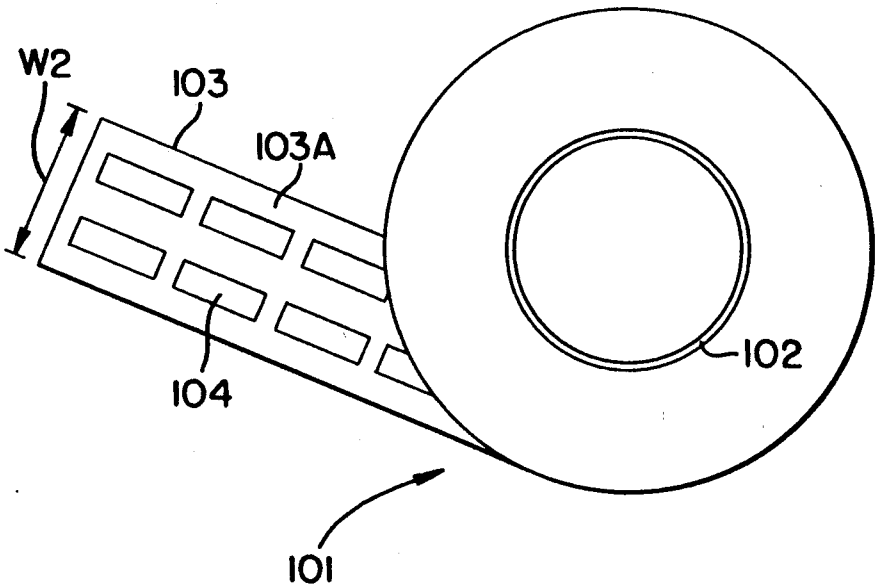

FIGS. 1A and 1B show typical label rolls 101 to be used with the dispenser of the present invention. Each label roll comprises an inner core member 102 around which is wound a liner or backing 103 carrying labels 104. The labels 104 are attached to the surface 103A of the liner by a releasable adhesive means such as an acrylic adhesive. The labels 104 typically may be detectable labels for use in an electronic article surveillance system. Labels of this type are disclosed for example in U.S. Pat. No. 4,660,025, assigned to the same assignee hereof.

The roll in FIG. 1A carries a single line of labels, while the roll in FIG. 1B carries dual or multiple lines of labels. The width W2 of the FIG. 1B roll is thus greater than the width W1 of the FIG. 1A roll.

Figure 2:
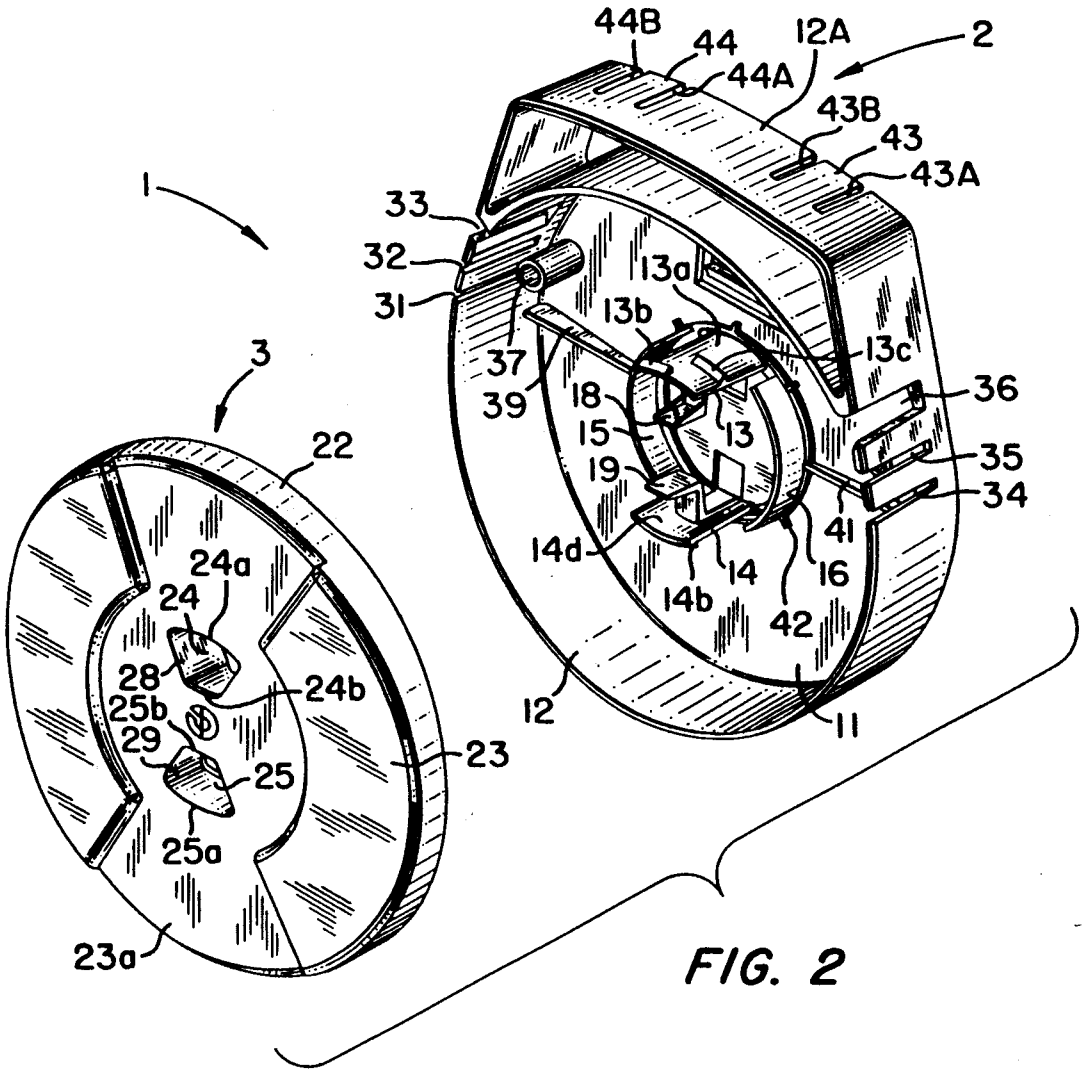
FIG. 2 shows an isometric view of a dispenser in accordance with the principles of the present invention with the cover and base of the dispenser separated.
Figure 6:
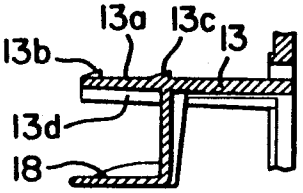
FIG. 6 shows an enlarged view of an interior wall and attached finger of the base member of FIG. 3.
Figure 4:
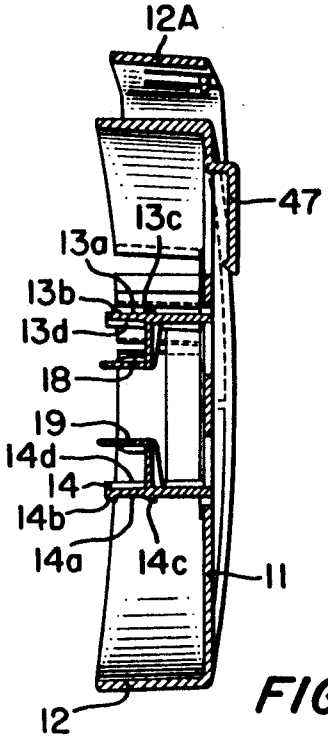
FIG. 4 shows a cross sectional view of the base member of FIG. 3 taken through the section line A—A in FIG. 3.
Figure 5:
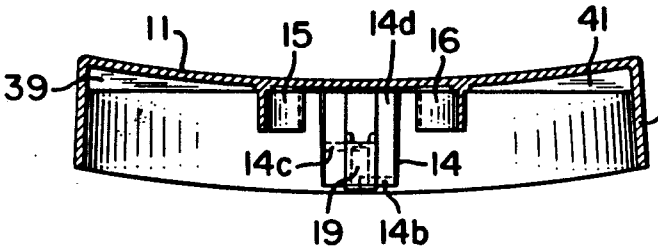
FIG. 5 shows a cross sectional view of the base member of FIG. 3 taken through the section line B—B in FIG. 3.
Figure 3:
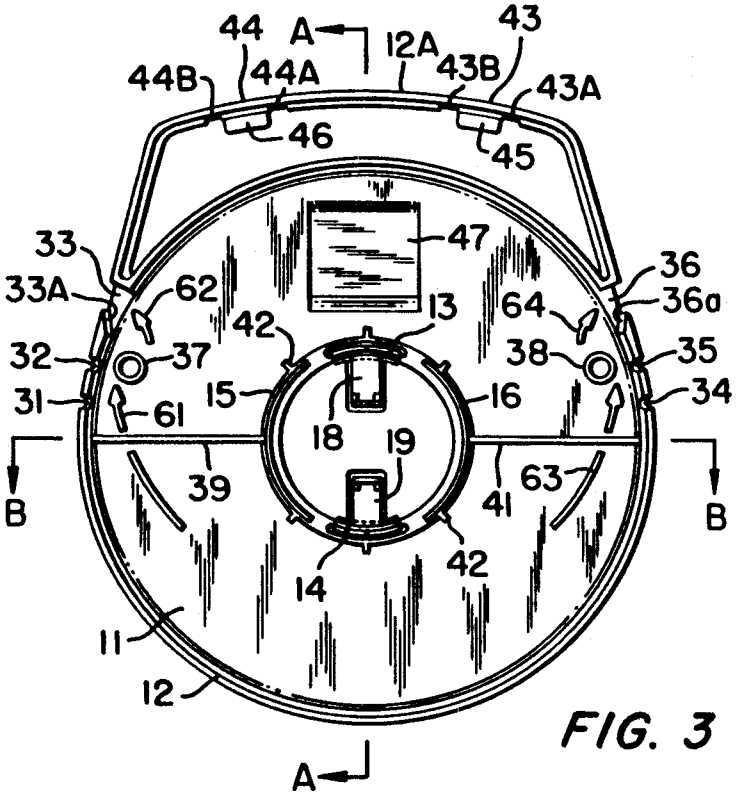
FIG. 3 shows a front plan view of the base member of the dispenser of FIG. 1.
Figure 8:
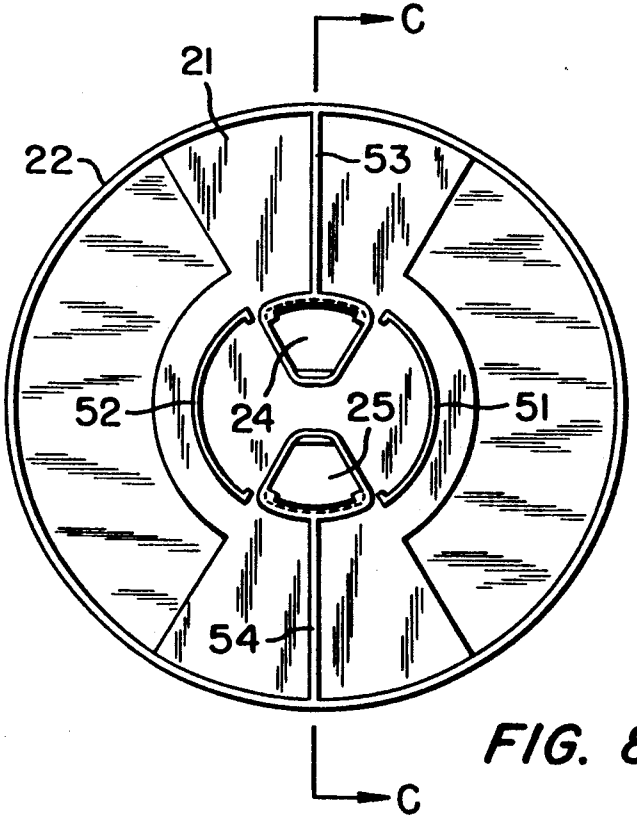
FIGS. 7 and 8 show front and back plan views of the cover member of the dispenser of FIG. 2.
Figure 10:
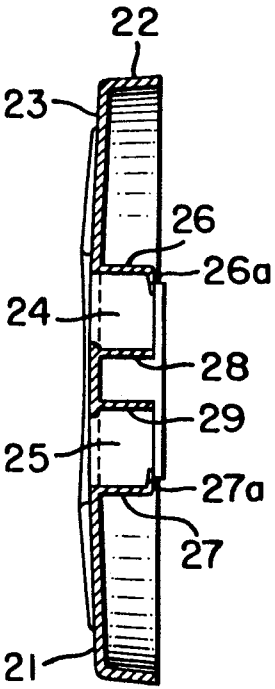
FIG. 10 shows a cross sectional view of the cover member of FIG. 8 taken through the section line C—C of FIG. 8.
Figure 9:
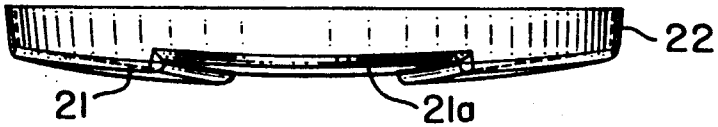
FIG. 9 shows a top plan view of the cover member of the dispenser of FIG. 2.
Figure 7:
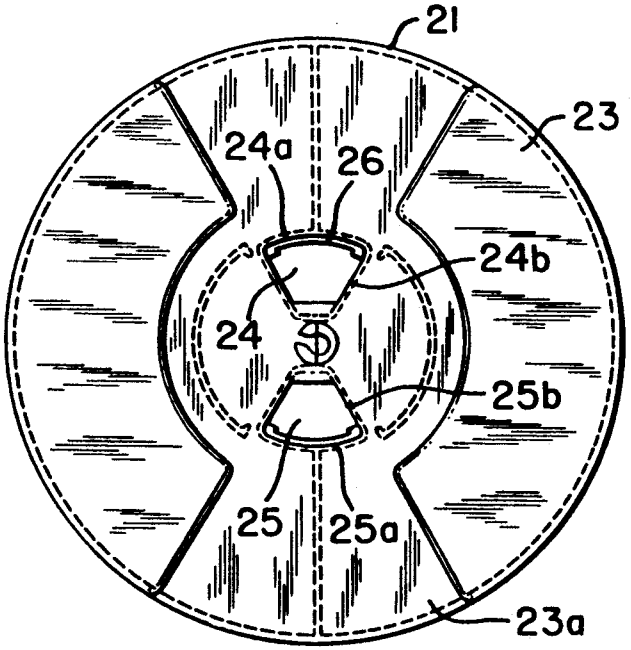

FIG. 2 shows a dispenser 1 for dispensing labels from the label rolls of FIGS. 1A and 1B in accordance with the principles of the present invention. The dispenser 1 comprises a base member 2 and a cover member 3 which are adapted to be attached so as to provide interior regions of different height for accommodating the different widths W1 and W2 of the label rolls of FIGS. 1A and 1B.

Referring to FIGS. 1–5, the base member 2 comprises a bottom wall 11 which is shown a being curved inwardly and as being circular. A side wall 12 extends upwardly from the periphery of the bottom wall 11 so that the base 2 is able to receive and house label rolls of maximum width at least equal to the larger width W2 of the rolls 101.

First and second bendable or flexible, oppositely disposed interior walls 13 and 14 extend upwardly from a central region of the bottom wall 11. The interior walls 13 and 14 are bendable or pivotable about their lower ends affixed to the bottom wall 11 and these ends are further curved to follow opposite arcuate portions of a circular path. Further oppositely disposed, upwardly extending curved interior walls 15 and 16 follow other opposite arcuate portions of this circular path and define with the lower ends of walls 13 and 14, a circular ring or shell 17 for receiving the inner core 102 of the label rolls to be housed in the base member.

The upper portions of the inner walls 13 and 14 at their outer surfaces **13*a*, 14*a* are further provided with longitudinally displaced upper and lower laterally extending ribs 13*b*, 13*c* and 14*b*, 14*c*. The ribs on each wall are laterally offset from each other and, as will be further described below, cooperate with elements on the cover member to latch the base member 2 to the cover member 3** at their different heights from the bottom wall.

Fingers 18 and 19 extend inwardly and then upwardly from the inner surfaces **13*d* and 14*d* of the interior walls 13 and 14. Inward forces applied to the upper ends of the fingers 18 and 19 thus bend the flexible walls 13 and 14 inward causing a corresponding inward displacement of the ribs 13*b*, 13*c* and 14*b*, 14*c*. This action is used to release the base member 2 from the cover member 3**, as will also be described in more detail hereinbelow.

The cover member 3 (see FIGS. 2 and 7–9) of the dispenser 1 includes a top wall 21 which is shown as curved or bent outwardly. The wall 21 is further shown as circular and carries about its periphery a downwardly extending rim or flange 22. The top wall 21 and rim 22 are dimensioned such that when the cover member 3 overlies the base member 2, the outer surface of the rim 22 is adjacent the inner surface of the side wall 12.

The top surface 23 of the top wall 21 is provided with a recessed area **23*a* whose central region contains spaced apertures 24 and 25. The apertures 24 and 25 are of decreasing width when proceeding inwardly of the cover 3 and are further arranged such that they receive and permit access to the fingers 18 and 19, respectively, when the cover member 3 is situated on the base member 2**.

Members in the form of downwardly and then inwardly extending rigid flanges 26 and 27 extend from outer peripheral edges **24*a* and 25*a* of the apertures 24 and 25. The inner ends 26*a*, 27*a* of these flanges are situated to engage and grip the outer surfaces 13*a* and 14*a* of the interior walls 13 and 14** of the base member 2, when the cover member 3 is placed on the base member 2. The remaining peripheral portions 24*b* and 25*b* of the apertures 24 and 25 carry further downwardly extending rigid tabs 28 and 29. These tabs form surfaces for gripping the cover member 3 and for limiting the inward movement of the fingers 18 and 19 during unlatching or withdrawal of the cover member from the base member as will be discussed more fully below.

To attach the cover member 3 to the base member 2, the cover member 3 is situated over the base with the ends 26*a* and 27*a* of the flanges 26 and 27 engaging the outer surfaces 13*a* and 14*a* of the interior walls 13 and 14 of the base member. The cover member 3 is then urged downwardly with the ends 26*a* and 27*a* sliding along the wall surfaces. During this sliding movement, the fingers 18 and 19 of the base member are received in and become accessible through the apertures 24 and 25 in the cover member.

When the ends 26*a* and 27*a* of the flanges 26 and 27 reach the upper ribs 13*b* and 14*b* which ribs are of an equal first height above the bottom wall 11, the flanges and, thus, the ends 26*a* and 27*a* cause the walls 13 and 14 to bend or flex inwardly toward each other about their bottom ends, thereby enabling the ends 26*a* and 27*a* to ride over and past the upper ribs. This action is facilitated by the contour of the ribs which slant or slope outwardly when proceeding downwardly along the ribs so as to establish inward forces from the downward movement of the flanges.

When the ends 26*a* and 27*a* of the flanges 26 and 27 are past the upper ribs, the walls 13 and 14 then retract, moving the upper ribs outward and above the ends 26*a* and 27*a*. At this position, there is a latching interaction between the ribs 13*b* and 14*b* and the ends 26*a* and 27*a*, since the horizontally extending, bottom walls of the ribs now act to block the flange ends and, therefore, the flanges 26 and 27 from upward movement. This position thus defines a first latching position for the cover member 3 and base member 2 at the first height of the upper ribs. By selecting this first height to accommodate the larger width label roll of FIG. 1B, the interior region of the dispenser 1 defined by the cover member latched to the base member at this first height will now tightly house the larger width roll.

If the cover member 3 is continued to be urged downwardly past the first latching position, the ends 26*a*, 27*a* of the flanges 26 and 27 will encounter the lower ribs 13*c*, 14*c*, which ribs are at an equal second height from the bottom wall 11 of base member 2. Here again, the ends 26*a* and 27*a* of the flanges 26 and 27 will cause the walls 13 and 14 to bend or flex inwardly toward each other thereby permitting the flange ends to ride over and past the lower ribs, which, like the upper ribs, are slanted outwardly, to create inward forces from the downward flange movement. When the flange ends are past the lower ribs, the walls 13 and 14 again retract causing outward movement of the ribs over and above the flange ends 26*a* and 27*a*.

A latching interaction between the ribs 13*a* and 14*a* and the ends 26*a* and 27*a* then occurs, since the horizontally extending, bottom walls of the ribs now block upward movement of the flange ends and their flanges 26 and 27. This position thus defines a second latching position for the cover member 3 and base member 2 at the second height of the lower ribs. By selecting this second height to accommodate the smaller width roll of FIG. 1A, the interior region of the dispenser 1 defined by the cover member latched to the base member at this height will now tightly house the smaller width roll.

In order to remove the cover member 3 from the base member 2 after it has been latched at either one of the above latching positions, the operator accesses the fingers 18 and 19 attached to the interior walls 13 and 14 by inserting two fingers (e.g., the thumb and index finger) of one hand into the apertures 24 and 25. The operator then urges the fingers 18 and 19 inwardly toward each other, while at the same time gripping the tabs 28 and 29 of the cover member with the two fingers.

The inward movement of the fingers 18 and 19 causes the inner walls 13 and 14 to bend or flex inwardly about their bottom ends, thereby displacing the ribs 13*b*, 14*b*, 13*c* and 14*c* inwardly. This releases the latching effect of the bottom walls of the ribs on the ends 26*a* and 27*a* of the flanges 26 and 27. The ends can thus now move upwardly past the ribs as the cover member 3 is urged upwardly by the operator via the tabs 28 and 29. Continued upward movement causes removal of the cover member 3 from the base member 2 so as to permit a new label roll to be inserted in the dispenser.

It should be noted that during the above removal procedure, the tabs 28 and 29 not only act to provide gripping surfaces bu additionally interact with the fingers 18 and 19 to limit their inward movement. This, in turn, limits the inward flexing of the walls 13 and 14 so as to prevent the walls from being flexed about then lower ends beyond their breaking points.

To provide for easy detachment of the labels on a roll from the roll liner, the base member 2 of the dispenser includes first and second sets of slots 31–33 and 34–36. These sets of slots are situated at opposite circumferential regions of the side wall 12 and permit labels to be dispensed from either side of the dispenser depending upon which set of slots is used.

The slots 33 and 36 of the sets are provided with respective surfaces 33*a* and 36*a* having sharp or acute angled edges to facilitate stripping of the individual labels from the supporting liner. In arranging the end of a roll in the slots, the roll end is first passed through either aperture 33 or 36 with the label side facing outward of the respective edge 33*a* or 36*a*. The end is then threaded through apertures 31–32 or 34–35. This results in the roll end being firmly held against the angled edge of the corresponding slot 33 or 36, thereby promoting detachment of the labels from the liner.

Hollow bosses 37 and 38 are also provided adjacent the slot sets 31–33 and 34–36. Each boss provides a guide for guiding the roll end between the side all 12 and the respective boss and into the adjacent slot 33 or 36. Arrows 61–62 and 63–64 imprinted into the bottom wall 11 provide visual direction for threading the roll end relative to the bosses and slots. The bosses 37 and 38 can also be used to vertically mount the dispenser by inserting screws through the bosses.

Radially extending supports or ribs 39 and 41 extend upwardly from the bottom wall 11 to support the body of the label roll in a level plane. These supports are aided by radical pins 42 which seat the core of the roll in the same plane.

A side wall extension 12A provides a handle for the dispenser. The side wall extension 12A is slotted at 43A and 43B and 44A and 44B to define flexible flanges 43 and 44 having inner ledges 45 and 46. These slots, flanges and ledges can receive and support a strap for shoulder wear and carrying of the dispenser.

The base member 2 is further provided with an L shaped clip 47. The latter clip extends downwardly below the bottom wall 11 and then inwardly and can be used to clip the dispenser 1 to the belt of an operator.

The cover member 3 on its interior surface is also provided with arcuate ribs 51, 52 and radial ribs 53, 54. These ribs serve as stops and engage the label roll when the cover is latched to the base member 2 as above-described.

The base member 2 and cover member 3 are each preferably formed as an integral unit. This can be accomplished by forming each as a molded element. Each element can furthermore comprise a plastic or some other moldable material. Advantageously, if each member is formed completely of a plastic material, each member is then recyclable.

In the above discussed embodiment of the invention, the latching flanges 26 and 27 of the cover member were disclosed as being substantially rigid members. However, these flanges also, could have been flexible, bendable or pivotable members adapted to provide the desired latching action.

In all cases it is understood that the above-described arrangements are merely illustrative of the many possible specific embodiments which represent applications of the present invention. Numerous and varied other arrangements can be readily devised in accordance with the principles of the present invention without departing from the spirit and scope of the invention.

What is claimed is:

1. A dispenser for use in dispensing label rolls of different widths comprising:

a base member including a bottom wall, a side wall extending about the periphery of the bottom wall and a first latching means for cooperating with a second latching means of a cover member to attach said base member and cover member together, said first latching means including: first and second spaced walls extending from the bottom wall of said base member, said first wall including a first surface having first upper and lower spaced laterally extending ribs and said second wall including a second surface having second upper and lower spaced laterally extending ribs; and first and second fingers affixed to and extending from said first and second walls, said first and second walls being bendable toward each other such that forces on said first and second fingers can cause bending of said first and second walls toward each other to the extent of displacing the first upper and lower ribs and the second upper and lower ribs;

a cover member including: a top wall; aperture means for accessing said first latching means when said cover member is placed on said base member, said aperture means including spaced first and second apertures situated in said top wall so as to permit access to said first and second fingers when said cover member is placed on said base member; and second latching means for cooperating with said first latching means to attach said base member and said cover member together, said second latching means including: first and second spaced latching flange members extending from said top wall of said cover member and being arranged to engage said first and second surfaces of said first and second walls of said base member when said cover member is placed over and urged toward said base member, said first and second latching flange members bending said first and second walls of said base member so as to pass over and past said first and second upper ribs of said first and second walls and allowing said first and second walls of said base member to retract and become latched to said first and second latching flange members by said first and second upper ribs of said first and second walls at a first latching position and bending said first and second walls of said base member so as to pass over and past said first and second lower ribs of said first and second walls and allowing said first and second walls of said base member to retract and become latched to said first and second latching flange members by said first and second lower ribs of said first and second interior walls at a second latching position;

and forces on said first and second fingers of said base member accessible through said first and second apertures bringing said first and second fingers toward each other causing said first and second upper ribs of said first and second walls of said base member to be brought toward each other and said first and second lower ribs of said first and second walls of said base member to be brought toward each other to allow said first and second latching flange members of said cover member to move past said first and second upper and lower ribs and, thereby, unlatch said first and second latching flange members from said first and second upper and lower ribs of said first and second walls of said base member and said cover member from said base member.

2. A dispenser in accordance with claim 1 wherein:

said first and second latching flange members extend in a substantially parallel relationship and then toward each other.

3. A dispenser in accordance with claim 1 wherein;

each rib of said first and second upper and lower ribs slopes in proceeding from the upper to lower end of the rib.

4. A dispenser in accordance with claim 1 wherein:

said first and second latching flange members extend from respective peripheral edges of said first and second apertures;

and said base member further includes first and second further members extending from respective peripheral edges of said first and second apertures for providing surfaces for gripping said cover member and limiting the movement of said first and second fingers.

5. A dispenser in accordance with claim 4 said first and second fingers extend toward each other and then in substantially parallel relationship so as to be adjacent said first and second further member, respectively, when said cover member is placed over and urged toward said based member.

6. A dispenser in accordance with claim 5 wherein:

the bottom wall of said base member is curved;

and said base member includes rib means extending from said bottom wall to define a level plane for engaging a label roll.

7. A dispenser in accordance with claim 6 wherein:

said rib means includes: first and second opposing radial ribs extending from said shell to said side wall of said base member for engaging the body of said label roll; and a number of further radial pins extending from said shell for engaging the core of said label roll.

8. A dispenser in accordance with claim 1 wherein:
said first and second walls are curved and follow arcuate portions of a circular path;
and said base member further includes third and fourth curved walls which follow other arcuate portions of said circular path;
said first through fourth walls defining a shell for receiving the core of a label roll.

9. A dispenser in according with claim 1 wherein:
each said aperture becomes narrower moving toward the central part of said base member.

10. A dispenser in accordance with claim 1 wherein:
the top wall of said cover member has a recessed area and said first and second apertures are in said recessed area of said top wall of said cover member.

11. A dispenser in accordance with claim 1 wherein:
said side wall of said base member includes a first slot for permitting exit of an end of a label roll.

12. A dispenser in accordance with claim 11 wherein:
said first slot has an acute angled edge.

13. A dispenser in accordance with claim 12 wherein:
said side wall of said base member includes second and third slots adjacent said first slot through which said end of said label roll is able to be threaded after exiting said bottom member through said first slot.

14. A dispenser in accordance with claim 13 further comprising:
a boss extending from said bottom surface of said base member adjacent said slots for guiding said end of said roll between said boss and said side wall of said base member toward said first slot.

15. A dispenser in accordance with claim 1 wherein:
said base member comprises a further side wall portion bridging a portion of said side wall of said base member, said further side wall portion of said base member forming a grip for carrying said dispenser.

16. A dispenser in accordance with claim 1 wherein:
said base member further includes: a wall section which extends outwardly and then adjacent the bottom wall of said base member to form a clip for mounting the dispenser to a belt.

17. A dispenser in accordance with claim 1 wherein:
said base member is an integral member;
and said cover member is an integral member.

18. A dispenser in accordance with claim 17 wherein:
said base member is a molded member;
and said cover member is a molded member.

19. A dispenser in accordance with claim 18 wherein:
said base member comprises a plastic material;
and said cover member comprises a plastic material.

20. A dispenser in accordance with claim 19 wherein:
said base member is formed entirely of a plastic material so as to be recyclable;
and said cover member is formed entirely of a plastic material so as to be recyclable.

21. A dispenser in accordance with claim 1 wherein:
said first and second latching flange members are substantially flexible.

22. A dispenser in accordance with claim 1 wherein:
the surface of the top wall of said cover member includes engagement means for engaging a label roll when said cover member is latched to said base member.

23. A dispenser in accordance with claim 22 wherein:
said engagement means of said cover member includes arcuate ribs bridging and extending between the outer peripheries of the first and second apertures for engaging the core of said label roll and radial ribs extending from the peripheries of said first and second apertures to the side wall of said cover member for engaging the body of said label roll.

24. A dispenser in accordance with claim 1 wherein:
said base member and said cover member are each formed as integral parts.

25. A dispenser in accordance with claim 24 wherein:
said cover member and said base member are each formed as molded members.

26. A dispenser in accordance with claim 25 wherein:
said cover member and base member are each formed of a plastic material.

27. A dispenser in accordance with claim 26 wherein:
said cover member and abase member are each formed entirely of a plastic material so as to be recyclable.

28. A dispenser in accordance with claim 1 wherein:
said base member further includes spaced hollow bosses extending from the bottom wall of said base member for vertically mounting said base member.

29. A dispenser in accordance with claim 1 wherein:
said first and second latching flange members are each substantially rigid.

30. A method for use in dispensing labels from label rolls having different widths comprising:
providing a base member including a bottom wall, a side wall extending about the periphery of the bottom wall and a first latching means for cooperating with a second latching means of a cover member to attach said base member to said cover member, said first latching means including: first and second walls extending from the bottom wall of said base member, said first wall including a first surface having first upper and lower spaced laterally extending ribs and said second wall including a second surface having second upper and lower spaced laterally extending ribs; and first and second fingers affixed to and extending from said first and second walls, said first and second walls being bendable toward each other such that forces on said first and second fingers can cause bending of said first and second walls toward each other to the extent of displacing the first upper and lower ribs and the second upper and lower ribs;
providing a cover member including: a top wall; aperture means for accessing said first latching means when said cover member is placed on said base, said aperture means including spaced first and second apertures situated in said top wall so as to permit access to said first and second fingers when said cover member is placed on said base member; and second latching means for cooperating with said first latching means to attach said base member and cover member together, said second latching means including: first and second spaced latching flange members extending from said stop wall of said cover member and being arranged to engage said first and second surfaces of said first and second walls of said base member when said cover member is placed over and urged toward said base member, said first and second latching flange members bending said first and second walls of said base member so as to pass over and past said first and second upper ribs of said first and second walls and allowing said first and second walls of said base member to retract and become latched to said first and second latching flange members by said first and second upper ribs of said first and second walls at a first latching position and bending said first and second walls of said base member so as to pass over and past said first and second lower ribs of said first and second walls of said base member and allowing said first and second walls of said base member to retract and become latched to said first and second latching flange member by said first and second lower ribs of said first and second walls of said base member at a second latching position;

placing a label roll having one of said first and second widths in said base member;

placing said cover member on said base member and urging said cover member toward said base member until said cover member is latched to said base member at the one of the first and second latching positions corresponding to the width of said label roll paced in said base member;

and accessing said first and second fingers of said base member through said first and second apertures and applying a force urging said first and second fingers toward each other so as to displace said first and second upper and lower ribs of said first and second walls of said base member to allow said first and second latching flange members of said cover member to move past said first and second upper and lower ribs and, thereby, unlatch said first and second latching flange members from said first and second upper and lower ribs of said first and second walls of said base member and said cover member from said base member.

* * * * *

UNITED STATES PATENT AND TRADEMARK OFFICE

CERTIFICATE OF CORRECTION

PATENT NO. : 5,294,068

DATED : March 15, 1994

INVENTOR(S) : Anthony Baro and Hans Witsky

It is certified that error appears in the above-indentified patent and that said Letters Patent is hereby corrected as shown below:

Col. 2, line 22. Change "a" to -- as --

Col. 4, line 10. Change "a" to -- as --

Col. 6, line 26. Change "bu" to -- but --

Col. 6, line 29. Change "then" to -- the --

Col. 6, line 51. Change "all" to -- wall --

Col. 8, line 51. After "claim 4" insert -- wherein: --

Col. 8, line 55. Change "ber" to -- bers --

Col. 9, line 29. After "slot" insert -- and --

Signed and Sealed this

Ninth Day of August, 1994

Bruce Lehman

*Attest:*

BRUCE LEHMAN

*Attesting Officer*

*Commissioner of Patents and Trademarks*